United States Patent [19]

Jin et al.

[11] Patent Number: 4,973,358

[45] Date of Patent: Nov. 27, 1990

[54] METHOD OF PRODUCING LIGHTWEIGHT FOAMED METAL

[75] Inventors: Iljoon Jin, Kingston; Lorne D. Kenny, Inverary; Harry Sang, Kingston, all of Canada

[73] Assignee: Alcan International Limited, Montreal, Canada

[21] Appl. No.: 403,588

[22] Filed: Sep. 6, 1989

[51] Int. Cl.[5] ..... B22D 27/00

[52] U.S. Cl. ..... 75/415; 164/79

[58] Field of Search ..... 75/20 F, 415 US; 164/79

[56] References Cited

U.S. PATENT DOCUMENTS

| | | | |
|---|---|---|---|
| 2,215,223 | 9/1940 | Lytle | 75/20 F |
| 2,793,949 | 5/1957 | Imich | 420/528 |
| 3,300,296 | 1/1967 | Hardy et al. | 75/20 |
| 3,843,353 | 10/1974 | Niebylski et al. | 75/20 |
| 3,940,262 | 2/1976 | Niebylski et al. . | |

FOREIGN PATENT DOCUMENTS

| | | |
|---|---|---|
| 109559 | 8/1980 | Japan . |
| 1424898 | 2/1976 | United Kingdom . |
| 1424899 | 2/1976 | United Kingdom . |

OTHER PUBLICATIONS

G. J. Davies et al; "Metallic Foams: Their Production, Properties and Applications", 1983, Journal of Material Science, 18, pp. 1899–1911.

*Primary Examiner*—Melvyn J. Andrews
*Attorney, Agent, or Firm*—Cooper & Dunham

[57] ABSTRACT

A method is described for producing foamed metal in which gaseous bubbles are retained within a mass of molten metal during foaming. The method comprises heating a composite of a metal matrix and finely divided solid stabilizer particles above the liquidus temperature of the metal matrix, discharging gas bubbles into the molten metal composite below the surface thereof to thereby form a foamed melt on the surface of the molten metal composite and cooling the foamed melt thus formed below the solidus temperature of the melt to form a solid foamed metal having a plurality of closed cells.

10 Claims, 2 Drawing Sheets

PARTICLE SIZE AND VOLUME FRACTION RANGES FOR FOAM

METHOD OF PRODUCING LIGHTWEIGHT FOAMED METAL

BACKGROUND OF THE INVENTION

This invention relates to a method of manufacturing a lightweight foamed metal, particularly a particle stabilized foamed aluminum.

Lightweight foamed metals have high strength-to-weight ratios and are extremely useful as load-bearing materials and as thermal insulators. Metallic foams are characterized by high impact energy absorption capacity, low thermal conductivity, good electrical conductivity and high absorptive acoustic properties.

Foamed metals have been described previously, e.g. in U.S. Pat. Nos. 2,895,819, 3,300,296 and 3,297,431. In general such foams are produced by adding a gas-evolving compound to a molten metal. The gas evolves to expand and foam the molten metal. After foaming, the resulting body is cooled to solidify the foamed mass thereby forming a foamed metal solid. The gas-forming compound can be metal hydride, such as titanium hydride, zirconium hydride, lithium hydride, etc. as described in U.S. Pat. No. 2,983,597.

Previously known metal foaming methods have required a restricted foaming temperature range and processing time. It is an object of the present invention to provide a new and improved metal foaming method in which it is not necessary to add a gas-evolving compound nor to conduct the foaming in the restricted melt temperature range and restricted processing time.

SUMMARY OF THE INVENTION

According to the process of this invention, a composite of a metal matrix and finely divided solid stabilizer particles is heated above the liquidus temperature of the metal matrix. Gas is introduced into the the molten metal composite below the surface of the composite to form bubbles therein. These bubbles float to the top surface of the composite to produce on the surface a closed cell foam. This foamed melt is then cooled below the solidus temperature of the melt to form a foamed metal product having a plurality of closed cells and the stabilizer particles dispersed within the metal matrix.

The foam which forms on the surface of the molten metal composite is a stabilized liquid foam. Because of the excellent stability of this liquid foam, it is easily drawn off to solidify. Thus, it can be drawn off in a continuous manner to thereby continuously cast a solid foam slab of desired cross-section. Alternatively, it can simply be collected and cast into a wide variety of useful shapes.

The success of this foaming method is highly dependent upon the nature and amount of the finely divided solid refractory stabilizer particles. A variety of such refractory materials may be used which are particulate and which are capable of being incorporated in and distributed through the metal matrix and which at least substantially maintain their integrity as incorporated rather than losing their form or identity by dissolution in or chemical combination with the metal.

Examples of suitable solid stabilizer materials include alumina, titanium diboride, zirconia, silicon carbide, silicon nitride, etc. The volume fraction of particles in the foam is typically less than 25% and is preferably in the range of about 5 to 15%. The particle sizes can range quite widely, e.g. from about 0.1 to 100 μm, but generally particle sizes will be in the range of about 0.5 to 25 μm with a particle size range of about 1 to 20 μm being preferred.

The particles are preferably substantially equiaxial. Thus, they preferably have an aspect ratio (ratio of maximum length to maximum cross-sectional dimension) of no more than 2:1. There is also a relationship between particle sizes and the volume fraction that can be used, with the preferred volume fraction increasing with increasing particle sizes. If the particle sizes are too small, mixing becomes very difficult, while if the particles are too large, particle settling becomes a significant problem. If the volume fraction of particles is too low, the foam stability is then too weak and if the particle volume fraction is too high, the viscosity becomes too high.

The metal matrix may consist of any metal which is capable of being foamed. Examples of these include aluminum, steel, zinc, lead, nickel, magnesium, copper and alloys thereof.

The foam-forming gas may be selected from the group consisting of air, carbon dioxide, oxygen, water, inert gases, etc. Because of its ready availability, air is usually preferred. The gas can be injected into the molten metal composite by a variety of means which provide sufficient gas discharge pressure, flow and distribution to cause the formation of a foam on the surface of the molten composite. It has been found that the cell size of the foam can be controlled by adjusting the gas flow rate, the impeller design and the speed of rotation of the impeller, where used.

In forming the foam according to this invention, the majority of the stabilizer particles adhere to the gas-liquid interface of the foam. This occurs because the total surface energy of this state is lower than the surface energy of the separate liquid-vapour and liquid-solid state. The presence of the particles on the bubbles tends to stabilize the froth formed on the liquid surface. It is believed that this may happen because the drainage of the liquid metal between the bubbles in the froth is restricted by the layer of solids at the liquid-vapour interfaces. The result is a liquid metal foam which is not only stable, but also one having uniform pore sizes throughout the foam body since the bubbles tend not to collapse or coalesce.

Methods and apparatus for performing the present invention will now be more particularly described by way of example with reference to the accompanying drawings, in which.

Figure 1:
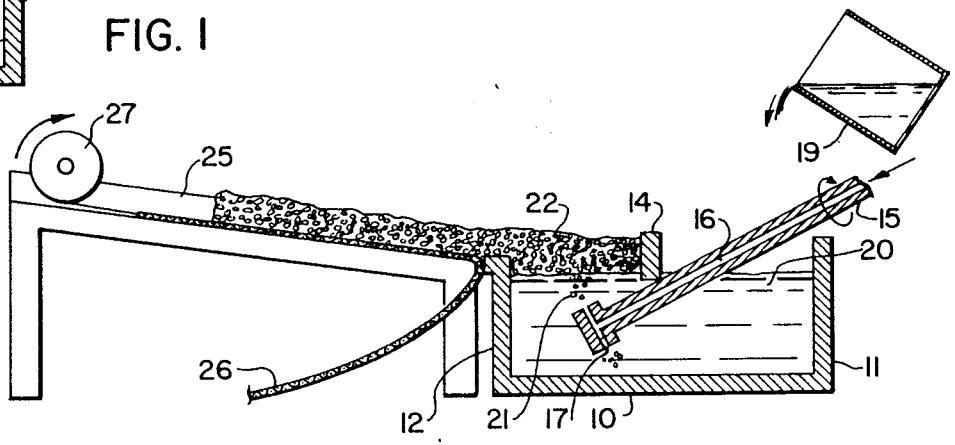
FIG. 1 illustrates schematically a first form of apparatus for carrying out the process of the invention.

A preferred apparatus of the invention as shown in FIG. 1 includes a heat resistant vessel having a bottom wall 10, a first end wall 11, a second end wall 12 and side walls (not shown). The end wall 12 includes an overflow spout 13. A divider wall 14 also extends across between the side walls to form a foaming chamber located between wall 14 and overflow spout 13. A rotatable air injection shaft 15 extends down into the vessel at an angle, preferably of 30°–45° to the horizontal, and can be rotated by a motor (not shown). This air injection shaft 15 includes a hollow core 16 for injecting air and outlet nozzles 17 at the lower end for discharging air into the molten metal composite 20 contained in the vessel. Air bubbles 21 are produced at the outlet of each nozzle and these bubbles float to the surface of the composite in the foaming chamber to produce a closed cell foam 22.

This closed cell foam in the above manner continuously forms and flows out of the foaming chamber over the foam spout 13. Additional molten metal composite 19 can be added to the chamber either continuously or periodically as required to replenish the level of the composite in the chamber. In this manner, the system is capable of operating continuously.

The cell size of the foam being formed is controlled by adjusting the air flow rate, the number of nozzles, the nozzle size, the nozzle shape and the impeller rotational speed.

Figure 2:
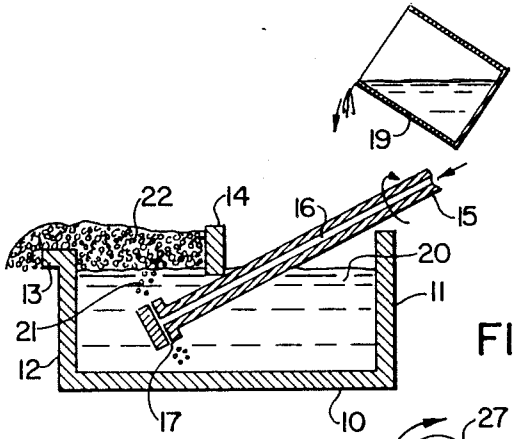
FIG. 2 illustrates schematically a second apparatus for carrying out the invention.
Figure 3:
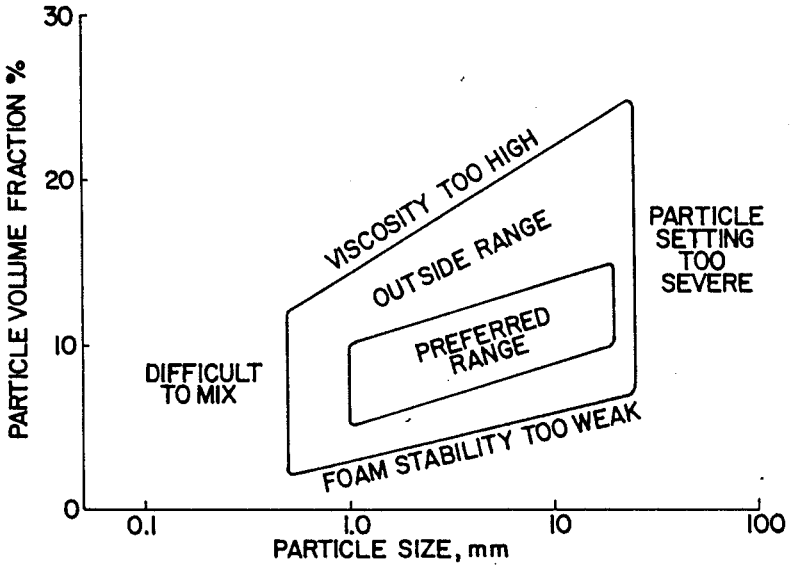
FIG. 3 is a plot showing the particle size and volume fraction range over which foam can be easily produced.

The system shown in FIG. 2 is designed to produce an aluminum foam slab with a smooth-as-cast bottom surface. This includes the same foam forming system as described in FIG. 1, but has connected thereto adjacent the foam spout 13 an upwardly inclined casting table 25 on which is carried a flexible, heat resistant, e.g. glass cloth, strip 26. This glass cloth strip is advanced by means of pulley 27 and picks up the foamed metal exiting over the foam spout 13. The speed of travel of the strip 26 is controlled to maintain a constant foam slab thickness.

If desired, the slab may also be provided with a smooth-as-cast top surface by providing a top constraining surface during casting of the slab.

EXAMPLE 1

Using the system described in FIG. 1, about 70 lbs. of aluminum alloy A356 containing 15 vol. % SiC particulate was melted in a crucible furnace and kept at 750° C. The molten composite was poured into the foaming apparatus of FIG. 1 and when the molten metal level was about 2 inches below the foam spout, the air injection shaft was rotated and compressed air was introduced into the melt. The shaft rotation was varied in the range of 0–1,000 RPM and the air pressure was controlled in the range 2–15 psi. The melt temperature was 710°C. at the start and 650°C. at the end of the run. A layer of foam started to build up on the melt surface and overflowed over the foam spout. The operation was continued for 20 minutes by filling the apparatus continuously with molten composite. The foam produced was collected in a vessel and solidified in air. It was found that during air cooling, virtually no cells collapsed.

Figure 4:
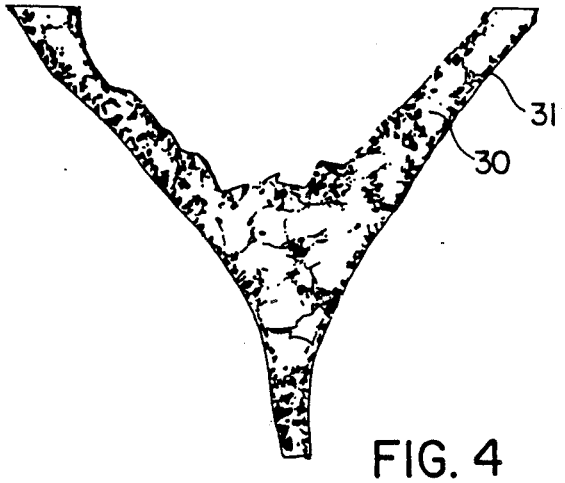
FIG. 4 is a schematic illustration of a detail of foam cell walls produced by the invention.

Examination of the product showed that the pore size was uniform throughout the foam body. A schematic illustration of a cut through a typical cell wall is shown in FIG. 4 with a metal matrix 30 and a plurality of stabilizer particles 31 concentrated along the cell faces. Typical properties of the foams obtained are shown in Table 1 below:

TABLE 1

| Property | Bulk Density (g/cc) 0.25 | 0.15 | 0.05 |
|---|---|---|---|
| Average cell size (mm) | 6 | 9 | 25 |
| Average Cell Wall Thickness (μm) | 75 | 50 | 50 |
| Elastic Modulus (MPa) | 157 | 65 | 5.5 |
| Compressive Stress* (MPa) | 2.88 | 1.17 | 0.08 |
| Energy Absorption Capacity* ($MJ/m^3$) | 1.07 | 0.47 | 0.03 |
| Peak Energy Absorbing Efficiency (%) | 40 | 41 | 34 |

*a 50% reduction in height

EXAMPLE 2

This test utilized the apparatus shown in FIG. 2 and the composite used was aluminum alloy A356 containing 10 vol. % $Al_2O_3$. The metal was maintained at a temperature of 650°–700°C. and the air injector was rotated at a speed of 1,000 RPM. Foam overflow was then collected on a moving glass-cloth strip. The glass cloth was moved at a casting speed of 3 cm/sec.

A slab of approximately rectangular cross-section (8 cm×20 cm) was made. A solid bottom layer having a thickness of about 1–2 mm was formed in the foam.

We claim:

1. A process for producing foamed metal wherein gaseous bubbles are retained within a mass of molten metal during the foaming, comprising the steps of:

heating a composite of a metal matrix and finely divided solid stabilizer particles above the liquidus temperature of the metal matrix, discharging gas bubbles into the molten metal composite below the surface thereof to thereby form a foamed melt on the surface of the molten metal composite and cooling the foamed melt below the solidus temperature of the melt to form a solid foamed metal having a plurality of closed cells.

2. A process according to claim 1 wherein the stabilizer particles are substantially equiaxial.

3. A process according to claim 2 wherein the stabilizer particles have an aspect ratio of up to 2:1.

4. A process according to claim 2 wherein the stabilizer particles are present in the metal matrix composite in an amount of less than 25% by volume.

5. A process according to claim 4 wherein the stabilizer particles have sizes in the range of about 0.1 to 100 μm.

6. A process according to claim 5 wherein the stabilizer particles have sizes in the range of about 0.5 to 25 μm and are present in the composite in an amount of 5 to 15% by volume.

7. A process according to claim 5 wherein the stabilizer particles are selected from the group consisting of alumina, titanium diboride, zirconia, silicon carbide and silicon nitride.

8. A process according to claim 5 wherein the foamed melt is removed from the surface of the composite before being solidified.

9. A process according to claim 8 wherein the foamed melt is continuously removed from the surface of the composite and is continuously formed into a solid foam slab.

10. A process according to claim 8 wherein the foamed melt is removed from the surface of the composite and is thereafter cast into any desired shape.

* * * * *